United States Patent [19]

Marino

[11] Patent Number: 5,070,634

[45] Date of Patent: Dec. 10, 1991

[54] LEFT-HANDED SLIDE CATCH

[76] Inventor: Salvatore J. Marino, 76 Billington La., Windsor, Calif. 95492

[21] Appl. No.: 671,392

[22] Filed: Mar. 19, 1991

[51] Int. Cl.[5] ..... F41A 17/42

[52] U.S. Cl. ..... 42/70.01

[58] Field of Search ..... 42/70.01

[56] References Cited

U.S. PATENT DOCUMENTS 1,896,820 2/1933 Jolidon ..... 42/70.01

3,492,748 2/1970 Swenson ..... 42/70.01

4,742,634 5/1988 Swenson ..... 42/70.01

FOREIGN PATENT DOCUMENTS 432422 10/1948 Italy ..... 42/70.01

*Primary Examiner*—Richard W. Wendtland

*Attorney, Agent, or Firm*—Limbach, Limbach & Sutton

[57] ABSTRACT

A modified slide catch is disclosed for standard semi-automatic pistols which can be operated by both right-handed and left-handed users.

3 Claims, 2 Drawing Sheets

LEFT-HANDED SLIDE CATCH

BACKGROUND OF INVENTION

There are several models of semi-automatic handguns of similar design with a frame, a slide mounted on top of the frame for movement between forward and rearward positions for firing and cartridge ejection respectively, a de-cocking safety lever at the rear of the slide, a magazine release device, and a slide catch pivotally mounted on the frame adjacent to the slide for movement between an upper slide latching position and a lower slide releasing position. Examples of such handguns are the Beretta Model 92F and the Smith & Wesson Model 6906.

Effective designs have evolved in these handguns for permitting right-handed and left-handed use of the de-cocking levers and magazine release devices, but no effective design has been developed for right and left handed use of the slide catches. The existing slide catches are positioned where the thumb of the right hand is used to press upwardly on the slide catch to engage the catch while the left hand operates the slide and press downwardly to release the catch. However, a left-handed user is unable to reach the slide catch with the left thumb. The result is that the left-handed user either opts to use the reverse hand technique which is time consuming and often dangerous due to the lack of ambidextrous skills required to keep the muzzle of the barrel pointed in a safe direction down range or a few left-handed users with sufficient strength and agility are able to engage the prior art slide catch by exerting upward pressure with the left index finger.

SUMMARY OF INVENTION

I have developed an improved side catch for handguns of the type described above which permits both right and left handed use. The design is extremely simple and does not interfere with the other features of the mechanisms whereby the gun is field stripped for cleaning and the like.

Basically I have taken the existing slide catch which is pivotally mounted on the left side of the frame adjacent to the slide for movement between an upper slide latching position and a lower slide releasing position with a boss on the slide catch rearwardly from the pivot for manipulation of the slide catch by the right thumb of a right-handed person, and I have added a boss on the forward side of the pivot which the left-handed user can manipulate with the trigger finger. Aside from achieving the basic objective of making the slide catch usable by left-handed people, another important safely advantage is achieved in that the user is required to remove the trigger finger from the trigger when engaging the slide catch.

It will be apparent that the forward boss for the left handed user can be used without the standard right-hand user boss with the added advantage of eliminating the risk that accidental engagement of the rearward boss can unintentionally engage the slide catch.

DETAILED DESCRIPTION

Figure 1:
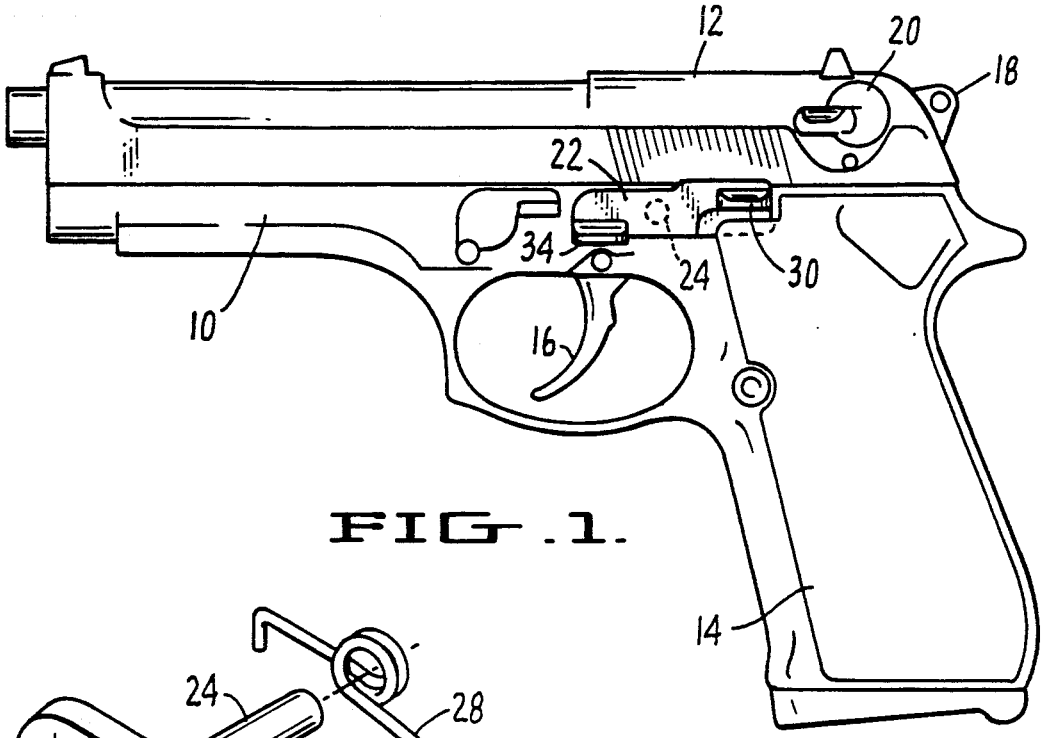
FIG. 1 is a side elevation view of a Beretta Model 92F modified to incorporate this invention.
Figure 2:
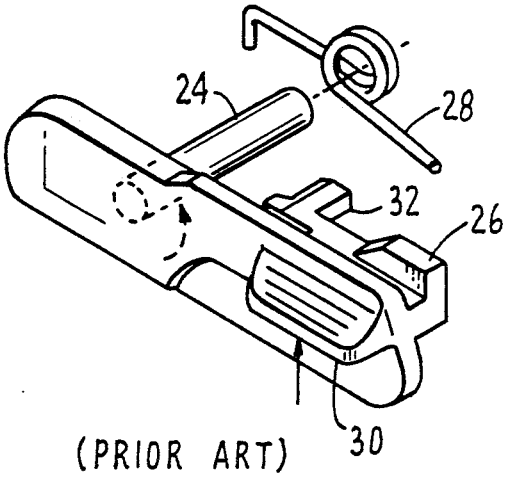
(PRIOR ART) FIG. 2.
FIG. 2 is a perspective view of the slide catch of the standard prior art Beretta Model 92F.
Figure 5:
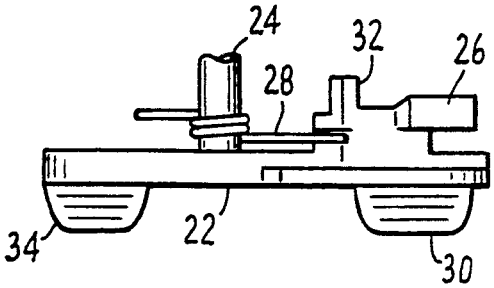
FIG. 5 is a top view of the slide catch of this invention.
Figure 3:
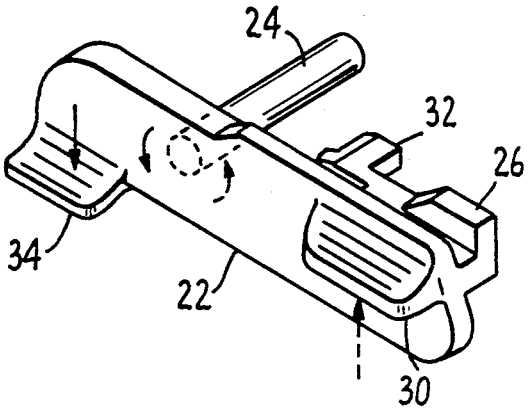
FIG. 3 is a similar perspective view of the side catch modified in accordance with this invention.
Figure 4:
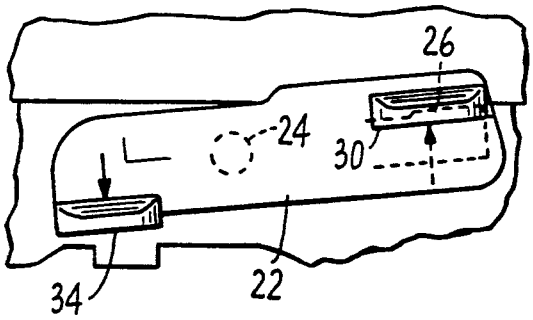
FIG. 4 is an enlarged side elevational view of the slide catch of this invention in a Beretta Model 92F.

Referring in detail to the drawings, the pistol shown in FIG. 1 has a frame 10, a slide 12, a pistol grip 14, trigger 16, a hammer 18, a de-cocking safety 20, and a slide catch 22. The slide catch is pivotally mounted in the frame by means of a pivot pin 24 which permits the slide catch to pivot counter-clockwise as viewed in FIG. 1 from an unlocking position, illustrated in FIG. 1, to a locking position, illustrated in FIG. 4. In the locking position, the slide is held in its withdrawn position exposing the open chamber at the top of the magazine, and in this position a catch 26 on the slide catch engages an interior shoulder in the slide 12. A torsion spring 28 holds the slide catch in its unlocked position, and the slide catch can be moved to its locking position either by pressure from the operator on a boss 30 or pressure from the empty magazine on a interior boss 32.

Figure 6:
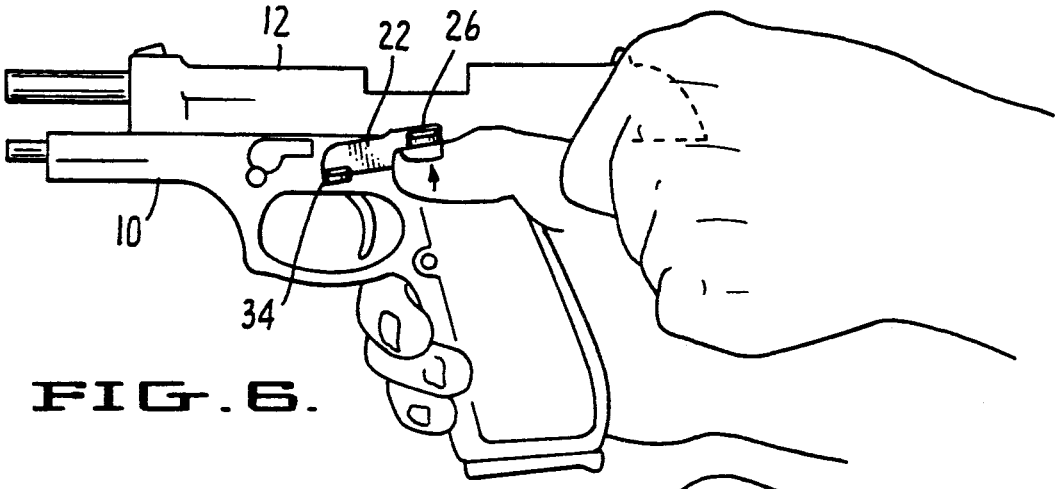
FIG. 6 is a side elevational view indicating the manner in which the slide catch and slide are manipulated by a right handed user.

The pistol thus far described is the prior art Beretta Model 92F. FIG. 6 illustrates the manner in which the right-handed user can operate the slide and slide catch to engage the slide catch and hold the chamber open. This is accomplished by applying pressure from the right thumb on the bottom of the boss 30 while the left hand grasps and holds the slide open.

It will be apparent that a left-handed user operating the same prior art mechanism is unable to operate it in the same manner as a right-handed user because the slide catch is on the wrong side of the frame to be manipulated by the thumb of the left-handed user. Accordingly it has been the practice for a left-handed user to pull upwardly on the boss 30 with the fingers of the user's right hand while grasping and withdrawing the slide with the right hand. This has the disadvantages mentioned above including the fact that holding the frame in this manner points the barrel of the weapon towards the user's right instead of down range.

Figure 7:
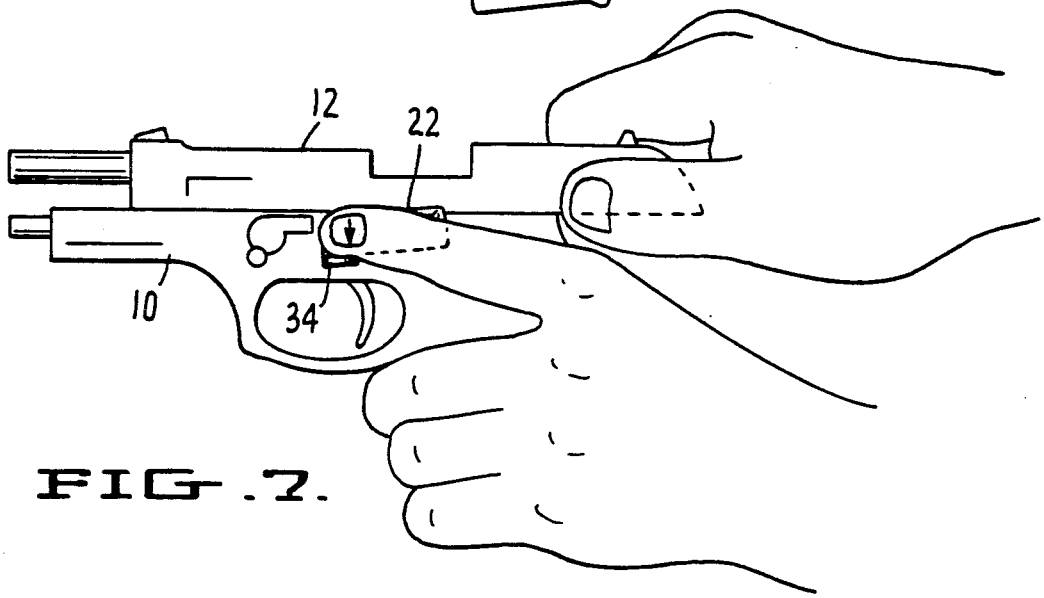
FIG. 7 is a side elevational view indicating the manner in which the slide catch and slide are manipulated by a left handed user.

In accordance with this invention, a second boss 34 is provided on the slide catch forward of the pivot pin 24 so that a left handed user can manipulate the slide catch by downward pressure on the boss 34 applied by the user's trigger finger as illustrated in FIG. 7.

The slide catch may be released by downward pressure on the boss 30 from the thumb of a right-handed user or downward pressure on the boss 30 by the trigger finger of the left-handed user, and alternatively the slide catch can be released using upward pressure on the boss 34 by the trigger finger of the left hand if slide tension is eased by the users right hand.

Figure 8:
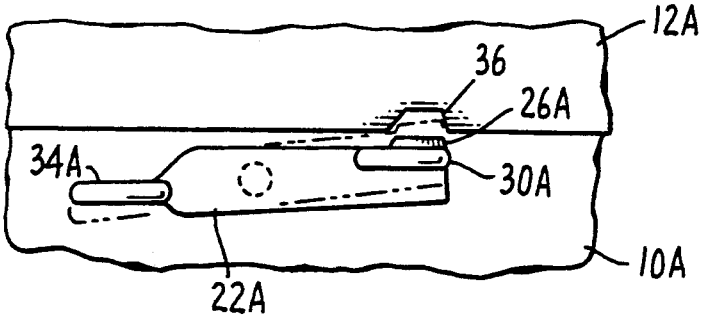
FIG. 8 is a side elevational view similar to FIG. 4 illustrating the manner in which the invention is used on a Colt Model 1911 semi-automatic .45 ACP Pistol or a Smith & Wesson Model 669 semi-automatic 9 mm Pistol.

FIG. 8 shows a similar construction for the slide catch as used in the Colt 45 and Smith & Wesson 9 mm where the letter A is added to a the reference numbers for corresponding parts, it being noted that the latching shoulder on the slide 12*a* for these models is visible from outside the slide.

While certain specific constructions for the invention have been illustrated and described herein in connection with pistols it is obvious that the invention can be used in a variety of ways within the scope of the following claims.

I claim:

1. In a semiautomatic hand operated gun adapted to be fired by a user utilizing the index finger as a trigger finger and having a frame, a slide mounted on top of the frame for movement between forward and rearward positions for firing and cartridge ejection respectively, and a slide catch pivotally mounted on the frame at a pivot adjacent to the slide for movement between an upper slide latching position and a lower slide releasing position, the improvement comprising a boss on the slide catch forward of the pivot for manipulation of the slide catch by the user's trigger finger.

2. In a semi-automatic handgun adapted to be fired by a right-handed person who has a right thumb and a right index finger and by a left-handed person who has a left thumb and a left index finger and having a frame with a left side as viewed in the direction of firing, a slide mounted on top of the frame for movement between forward and rearward positions for firing and cartridge ejection respectively, and a slide catch pivotally mounted on the left side of the frame at a pivot adjacent to the slide for movement between an upper slide latching position and a lower slide releasing position with a boss on the slide catch rearwardly from the pivot for manipulation of the slide catch by the right thumb of a right-handed person, the improvement comprising a boss on the slide catch forward of the pivot for manipulation of the slide catch by the index finger of a left-handed person.

3. An improved slide catch adapted for right-handed users having right thumbs and left-handed users having left index fingers where the improved slide catch is adapted for use in a semi-automatic handgun having a frame with a left side viewed in the firing direction, a slide mounted on top of the frame for movement between forward and rearward positions for firing and cartridge ejection respectively, and a slide catch pivotal support on the left side of the frame adjacent to the slide for supporting a slide catch for movement between an upper slide latching position and a lower slide releasing position, the improved slide latch comprising an integral body having a pivot pin adapted to fit in the slide catch pivotal support with the body having a boss rearwardly from the pivot for manipulation of the slide catch by the right thumb of a right-handed person and a boss forward of the pivot for manipulation of the slide catch by the index finger of a left-handed person.

* * * * *